United States Patent [19]

Brentham

[11] Patent Number: 4,566,692

[45] Date of Patent: Jan. 28, 1986

[54] COMPUTERIZED EXERCISING DEVICE

[76] Inventor: Jerry D. Brentham, 2121 Industrial Park Rd., Belton, Tex. 76513

[21] Appl. No.: 495,806

[22] Filed: May 18, 1983

[51] Int. Cl.[4] ..... A63B 21/00

[52] U.S. Cl. ..... 272/130

[58] Field of Search ..... 272/130

[56] References Cited

U.S. PATENT DOCUMENTS

| | | | |
|---|---|---|---|
| 4,063,726 | 12/1977 | Wilson | 272/130 |
| 4,235,437 | 11/1980 | Ruis et al. | 272/130 |
| 4,240,627 | 12/1980 | Brentham | 272/130 |
| 4,247,098 | 1/1981 | Brentham | 272/130 |
| 4,254,949 | 3/1981 | Brentham | 272/130 |
| 4,291,787 | 9/1981 | Brentham | 272/130 |
| 4,354,676 | 10/1982 | Ariel | 272/130 |
| 4,441,708 | 4/1984 | Brentham | 272/130 |
| 4,448,412 | 5/1984 | Brentham | 272/130 |

*Primary Examiner*—Richard C. Pinkham
*Assistant Examiner*—Leo P. Picard
*Attorney, Agent, or Firm*—Gerald G. Crutsinger; John F. Booth; Monty L. Ross

[57] ABSTRACT

An exercising device comprising a computer associated with an actuating arm pivotally mounted on a frame, movement of the actuating arm being resisted by a double acting hydraulic cylinder. Position and pressure sensors associated with the hydraulic cylinder and the actuating arm deliver signals through the microprocessor to the computer for indicating power or work exerted by a user for moving the actuating arm. The double acting cylinder has a control valve to permit independent adjustment of resistance to movement of the piston in opposite directions.

24 Claims, 16 Drawing Figures

FORCE D1
POWER D2
WORK D3
A. WORK D0
T. POWER D1
RECALL D0
EXTRA D2
CAL D3
POWER D2
WORK D3
T. POWER D1
A. WORK D0
FORCE D1
TO SWITCHES
LEFT D0
RIGHT D1
EXTENTION D0
FLEXION D1
TO SWITCHES
EXTENTION
FLEXION
LEFT
RIGHT
RESET
D2 OR D3

COMPUTERIZED EXERCISING DEVICE

BACKGROUND OF INVENTION

Exercising devices of the type disclosed in U.S. Pat. No. 4,291,787 are well known to persons skilled in the art and widely used by physical education instructors and physical therapists to strengthen and rehabilitate muscles.

Since body movement involves an extremely complex arrangement of muscles attached to parts of the body to provide movement when the muscles shorten, the maximum force exerted by a body member through a full range of movement varies throughout the range of movement of the body member. For building and rehabilitating muscles, it is desirable that force exerted at various times or angles throughout the range of movement of the body member be known to facilitate prescription of therapy or exercises which will be most beneficial. Further, it is desirable that certain exercises be performed but not others for developing and rehabilitating muscles. For example, for rehabilitating certain knee injuries, it is desirable to provide exercise for certain muscles but not others and to limit movement to a prescribed range.

A primary object of the present invention is to provide sensors associated with a lever or arm which is actuated by the user, in combination with apparatus for indicating power or work done at various angles of rotation.

A further object of the invention is to provide an improved double acting hydraulic cylinder together with a control valve to permit independent adjustment of resistance to movement of the piston in each direction or to resist movement of the piston selectively in either direction but not in the other direction.

In accordance with the invention, the exercising device comprises a frame having a lever arm pivotally secured thereto and a double acting hydraulic cylinder connected between the frame and the lever arm to resist movement of the lever arm. A valve associated with the cylinder is provided with valve elements having passages of varying dimensions to permit independent adjustment of the restriction to fluid flowing from opposite ends of the cylinder such that the force required to extend the rod from one end of the cylinder may differ from the force required to retract the rod back into the cylinder. Pressure transducers are arranged to provide a signal related to pressure required to move the piston through the cylinder in opposite directions. A potentiometer is positioned to supply an output signal related to the position of the lever arm as it rotates about a pivot point. Signals from the pressure transducers and from the potentiometer are delivered through signal conditioning circuits, an analog to digital converter circuit to a microprocessor. The microprocessor is adapted to be reset at the beginning of a timed cycle and to indicate the number of repetitions, elapsed time, accumulated work and power; and work, power and peak load for any single previous repetition. The microprocessor is further adapted to indicate the work or power during flexion and extension of right and left body members for purposes of comparison of the strength of the body members. The output from the microprocessor is delivered to the input of a conventional home computer for data processing, graphic illustration and storage of data.

BRIEF DESCRIPTION OF DRAWINGS

Drawings of a preferred embodiment of the invention are annexed hereto so that the invention may be better and more fully understood, in which.

DESCRIPTION OF A PREFERRED EMBODIMENT

Figure 1:
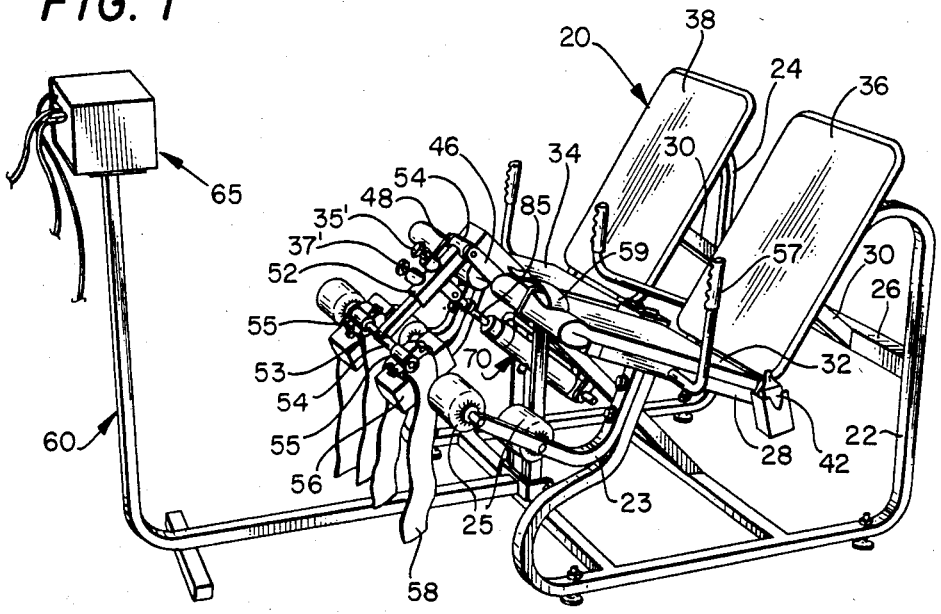
FIG. 1 is a perspective view showing the front and left side of the exercising device incorporating the invention.
Figure 2:
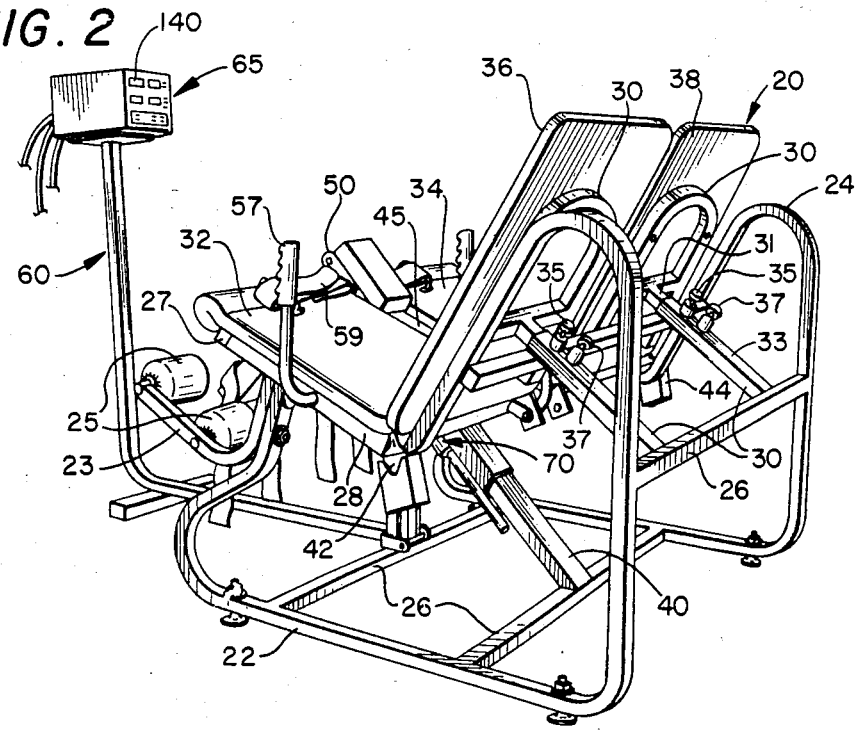
FIG. 2 is a perspective view showing the rear and left side thereof.

An exercising device, generally designated by the numeral 20, embodying the invention is illustrated in FIGS. 1 and 2 of the drawing. The exercising device 20 comprises generally vertically extending side frame members 22 and 24 connected by laterally extending tie bars 26 and 27. Side frame members 22 and 24 are of substantially identical construction and each is shaped to provide a seat support 28 and a mounting for a back support 30.

As best illustrated in FIG. 1 of the drawing, seats 32 and 34 are slightly inclined, for example, at an angle of 15° from a horizontal plane such that the front edge of the seat is elevated above the rear edge. Seat backs 36 and 38 are mounted adjacent seats 32 and 34, respectively, and each seat back is inclined at an angle of approximately 110° relative to the plane of seats 32 and 34, or approximately 125° relative to a horizontal plane.

From the foregoing, it should be readily apparent that when a user is seated on seat 32 and leaning back against back rest 36, he is in a slightly inclined position. A pair of seat belts 42 and 44 are provided for restraining the user relative to seat 32 and back 36 of the exercising device.

Each seat back 36 and 38 is mounted on a back support 30 having a bar 31 extending rearwardly therefrom and received in a hollow tube 33 welded or otherwise secured to the frame. Each tube 32 has an adjustment screw 35 threadedly secured therein to be selectively positioned in spaced apertures formed through bars 31 for adjusting the position of each seat back 36 and 38 relative to seats 32 and 34. Lock screws 37 are threadedly secured through the wall of tubular members 33 to engage the outer surface of each bar 31 to prevent movement of bar 31 and the associated seat back relative to tubular members 33.

A cylinder support bar 40 has a lower end secured to one of the tie bars 26 adjacent the lower rear portion of the frame and a front end secured to a tie bar 27 which supports the front edge of seats 32 and 34. A console 45 is mounted on the upper end of cylinder support bar 40 and is positioned between seats 32 and 34 to support a valve assembly, as will be hereinafter more fully explained.

Cylinder support bar 40 has spaced ears 46 and 48 extending forwardly of the upper end thereof for rotatably supporting a pivot pin 50. A hollow tubular actuating arm 52 is welded or otherwise secured to a hollow cylindrical bushing 54 which is rotatably supported by pivot pin 50. The length of actuating arm 52 may be adjusted by an adjustment screw 35' and a lock screw 37' in the same manner as hereinbefore described for the adjustment of seat backs 36 and 38.

The lower portion 53 of actuating arm 52 has a rod 54 welded or otherwise secured thereto for rotatably supporting bearing sleeves 55 having pads 56 secured thereto. Pads 56 are adapted to engage the front of the shin of the user and are provided with ankle straps 58 for maintaining the shin of the user in engagement with the pads 56.

Thigh straps 59 are provided to engage the thigh of a user when seated on seat 32 or 34.

Handle bars 57 are provided adjacent opposite sides of each of the seats 32 and 34 to be gripped by the hands of the user to facilitate stabilizing the body of the user. It should be readily apparent that when a user is seated on seat 32 or 34 his body will be restrained by seat belt 42, ankle strap 58 and thigh strap 59 to stabilize the body of the user. To further stabilize the body, padded cylinders 25 are secured by brackets 23 to side frame members 22 and 24. The leg of the user which is not being exercised is positioned between padded cylinders 25 to prevent movement of the leg which is not being exercised.

As will be hereinafter more fully explained, a computer stand generally designated by numeral 60 is secured in front of the exercising device to support a microprocessor housing 65.

Figure 6:
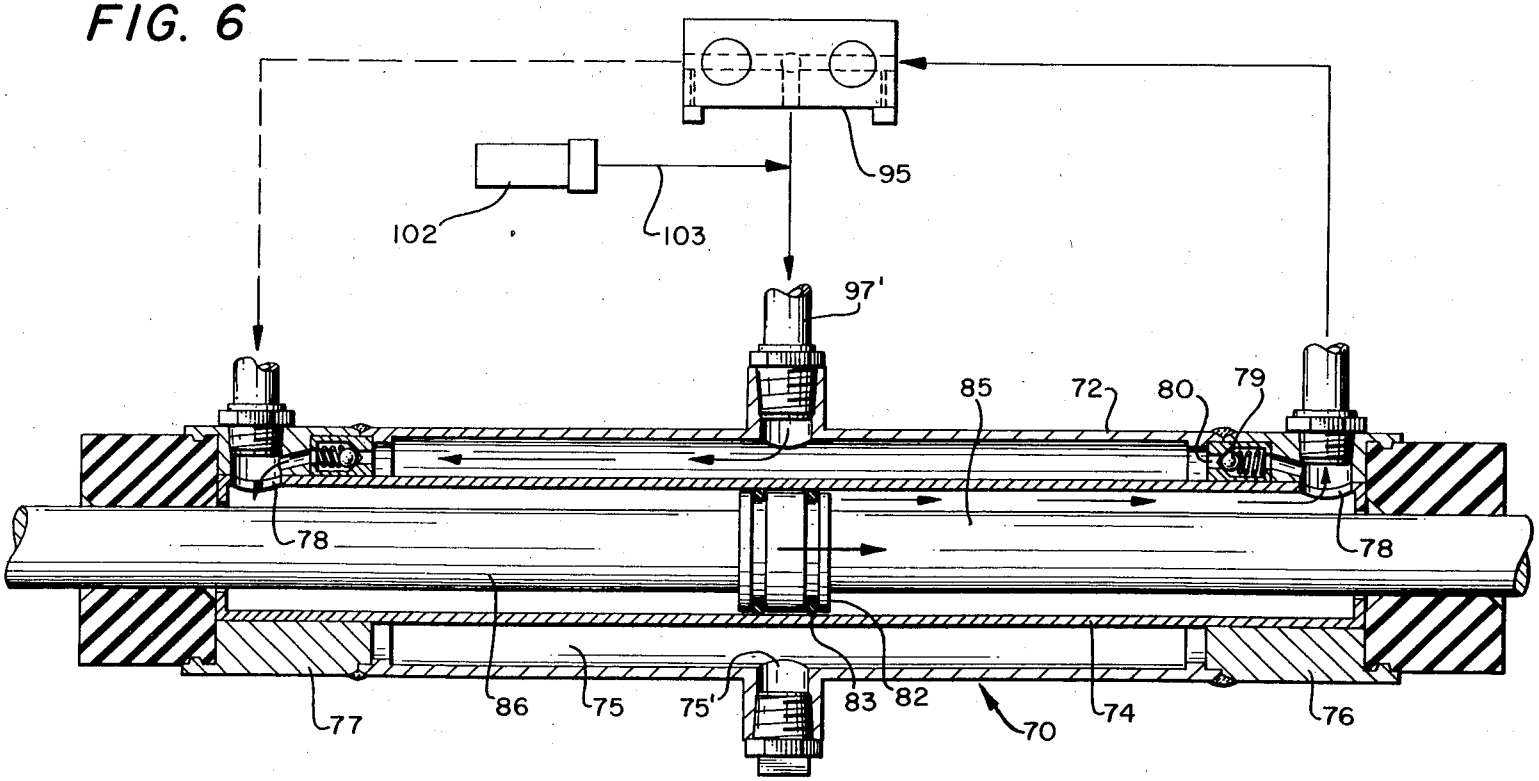
FIG. 6 is an enlarged partially sectionalized view of the hydraulic cylinder.
Figure 7:
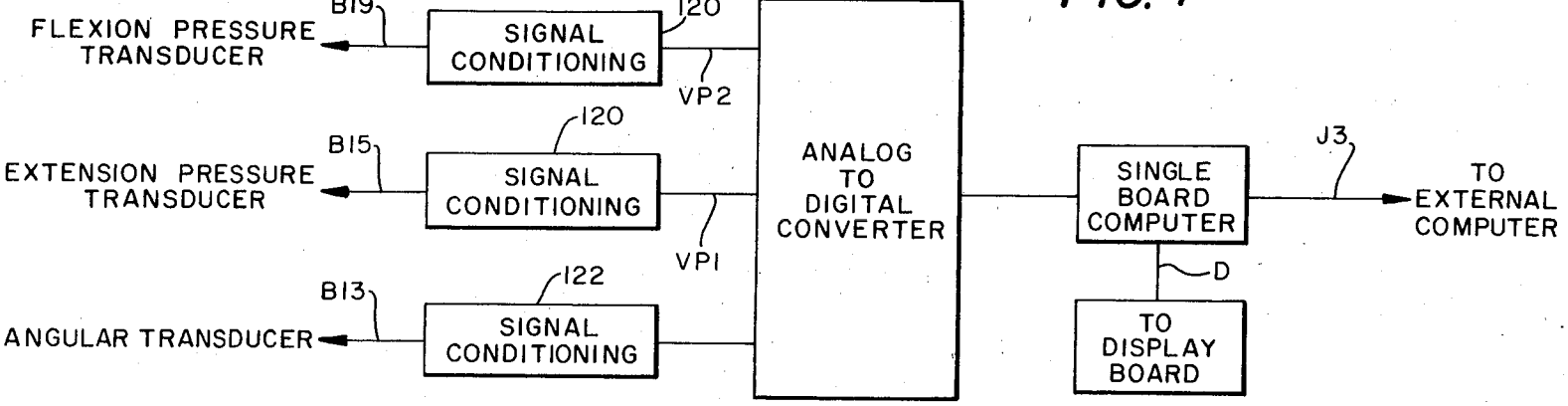
FIG. 7 is a block diagram of the microprocessor circuit.

Movement of actuating arm 52 about pivot pin 50 is resisted by a double acting hydraulic cylinder 70, which as best illustrated in FIG. 6 of the drawing, comprises a cylindrical tubular member 72 having a cylinder housing 74 extending axially therethrough for forming a reservoir 75 in the annulus between cylindrical members 72 and 74. End plugs or cylinder caps 76 and 77 are of identical construction and each is provided with a threaded passage 78 which extends through member 72, 74 and 76 for connecting a hydraulic line in fluid communication with the inside of cylinder 74 as will hereinafter be more fully explained. Plug members 74 are provided with spring loaded check valves 79 in ports 80 which extend between the reservoir in the annulus 75 and passage 78 to permit substantially unrestricted flow of fluid from reservoir 75 into passages 78 but blocking flow of fluid from passage 78 through port 80 into the reservoir 75.

A piston 82 having seal rings 83 mounted thereon is slidably disposed through cylinder 74 and has rods 85 and 86 extending through passages formed in cylinder caps 76 and 77. Thus, when rod 85 is extended, rod 86 is retracted.

Figure 3:
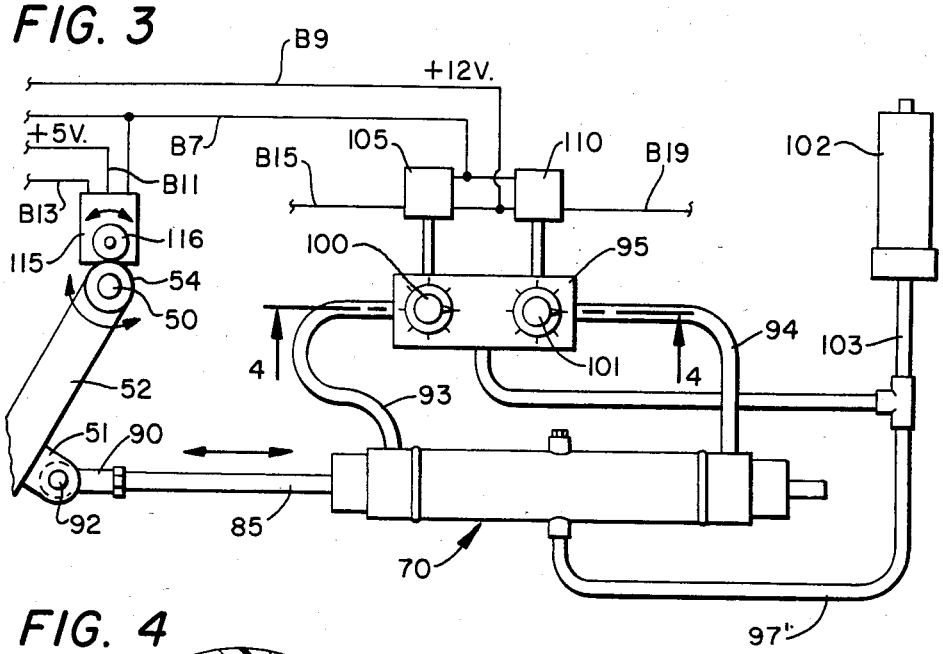
FIG. 3 is a diagrammatic view of the lever arm, hydraulic cylinder and associated valving and sensors for providing input to the microprocessor.

Referring to FIG. 3, rod 85 has a rod eye 90 on the outer end thereof pivotally secured by a pin 92 to lugs 51 on a central portion of actuating arm 52. Cylinder 70 is pivotally secured by pins 71 to cylinder support bar 40. Rod 86 on the opposite end of the cylinder is preferably provided with a stop **86*a* to limit movement of piston 82 to selectively limit the range of angular movement of arm 52**.

As best illustrated in FIG. 3 of the drawing, opposite ends of cylinder 70 are connected through lines 93 and 94 to a control valve 95.

Figure 4:
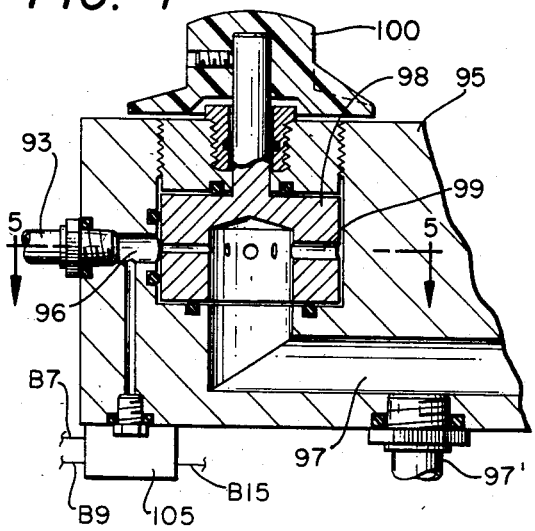
FIG. 4 is a cross sectional view taken along line 4—4 of FIG. 3.
Figure 5:
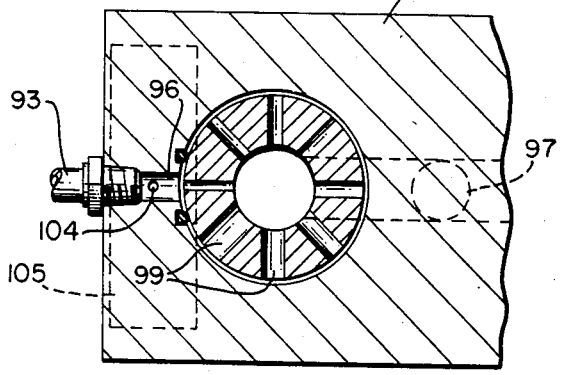
FIG. 5 is a cross sectional view taken along line 5—5 of FIG. 4.

As illustrated in FIG. 4 of the drawing, valve body 95 has a valve element 98 rotatably secured in a chamber communicating with inlet passage 96 and with an outlet passage 97. Valve element 98 has a plurality of metering orifices of varying diameter for placing inlet passage 96 in fluid communication with outlet passage 97. Valve element 98 is rotated to a desired position by rotation of a knob 100 accessible from the console 45 between seats 32 and 34 of exercising device 20. A second knob 101 is positioned for controlling a second valve element to adjust flow through line 94 from the opposite end of double acting hydraulic cylinder 70. As best illustrated in FIG. 5 of the drawing, metering orifices 99 preferably vary in diameter and in the illustrated embodiment, orifices of eight different sizes are provided.

A return line 97' is positioned in communication with return passage 97 in valve body 95 and is connected to a return port communicating with reservoir 75 in cylinder 70. Cylinder 70 is preferably provided with a fill port 75' to facilitate filling the system with hydraulic fluid. An accumulator 102 is connected through a line 103 to return line 97' and is preferably charged to a pressure of approximately 10 pounds per square inch.

Pressure transducers 105 and 110 are connected in fluid communication with the inlet passage 96 in valve body 95 through a passage 104. Pressure transducers 105 and 110 are of conventional design and deliver an output signal related to fluid pressure. As illustrated in FIG. 3 of the drawing, conductor B9 is connected to a 12 volt source and to transducers 105 and 110. Pressure transducers 105 and 110 are connected through a line B7 to ground. The output of pressure transducers 105 and 110 is delivered through conductors B15 and B19, respectively, to a microprocessor. As will be hereinafter more fully explained, signals from conductors B15 and B19 are used to indicate fluid pressure in opposite ends of cylinder 70.

Bearing sleeve 54, secured to the upper end of arm 52 is actuated by a user. A potentiometer 115 having a wheel 116 mounted thereon is positioned such that bearing 54 and wheel 116 are in rolling engagement. Thus, as arm 52 is rotated about pin 50 the output of potentiometer 115 will vary to indicate an angular position of arm 52 relative to the plane of seats 32 and 34. Potentiometer 115 is connected through a conductor B11 to a five volt source and through conductor B7 to ground. The output or wiper of potentiometer 115 is connected through conductor B13 to the microprocessor as will be hereinafter more fully explained.

Figure 9:
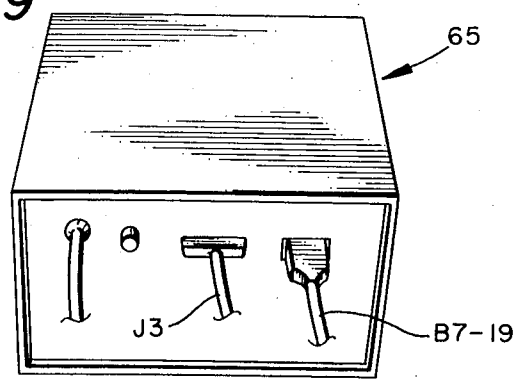
FIG. 9 is a perspective view showing the top and rear of the microprocessor housing.
Figure 10A:
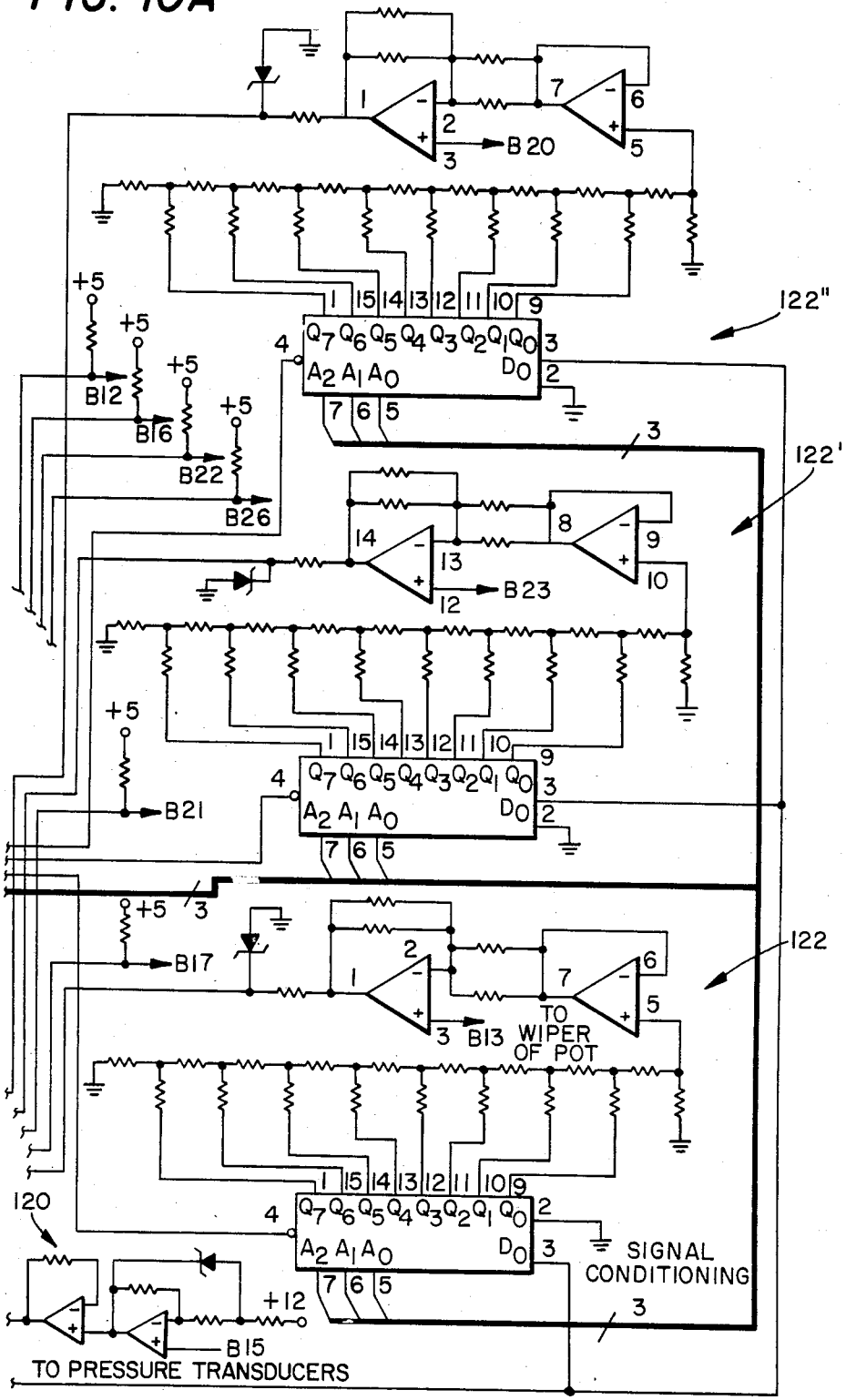
FIGS. 10A, 10B and 10C are wiring diagrams of the microprocessor circuit.
Figure 10B:
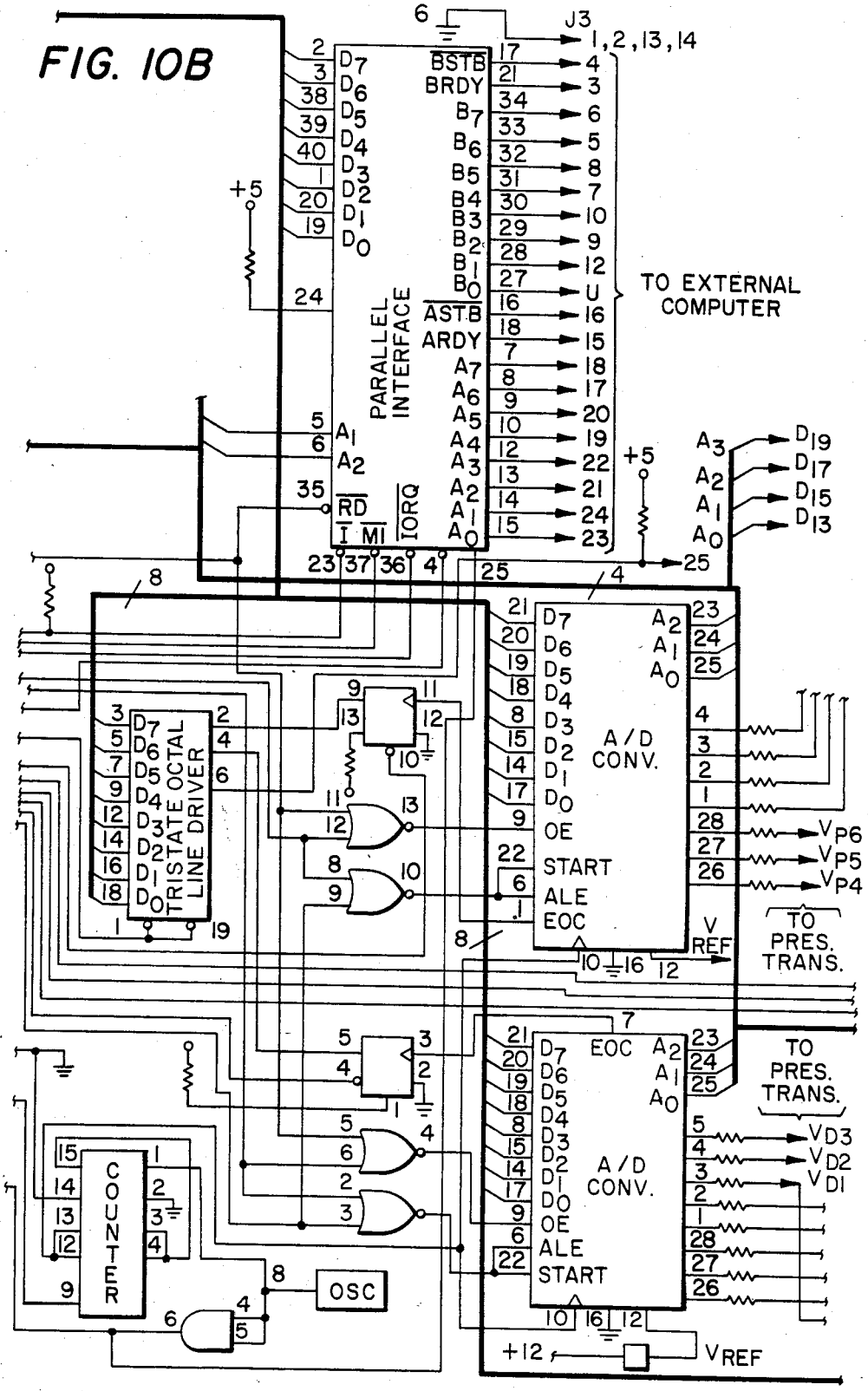
Figure 10C:
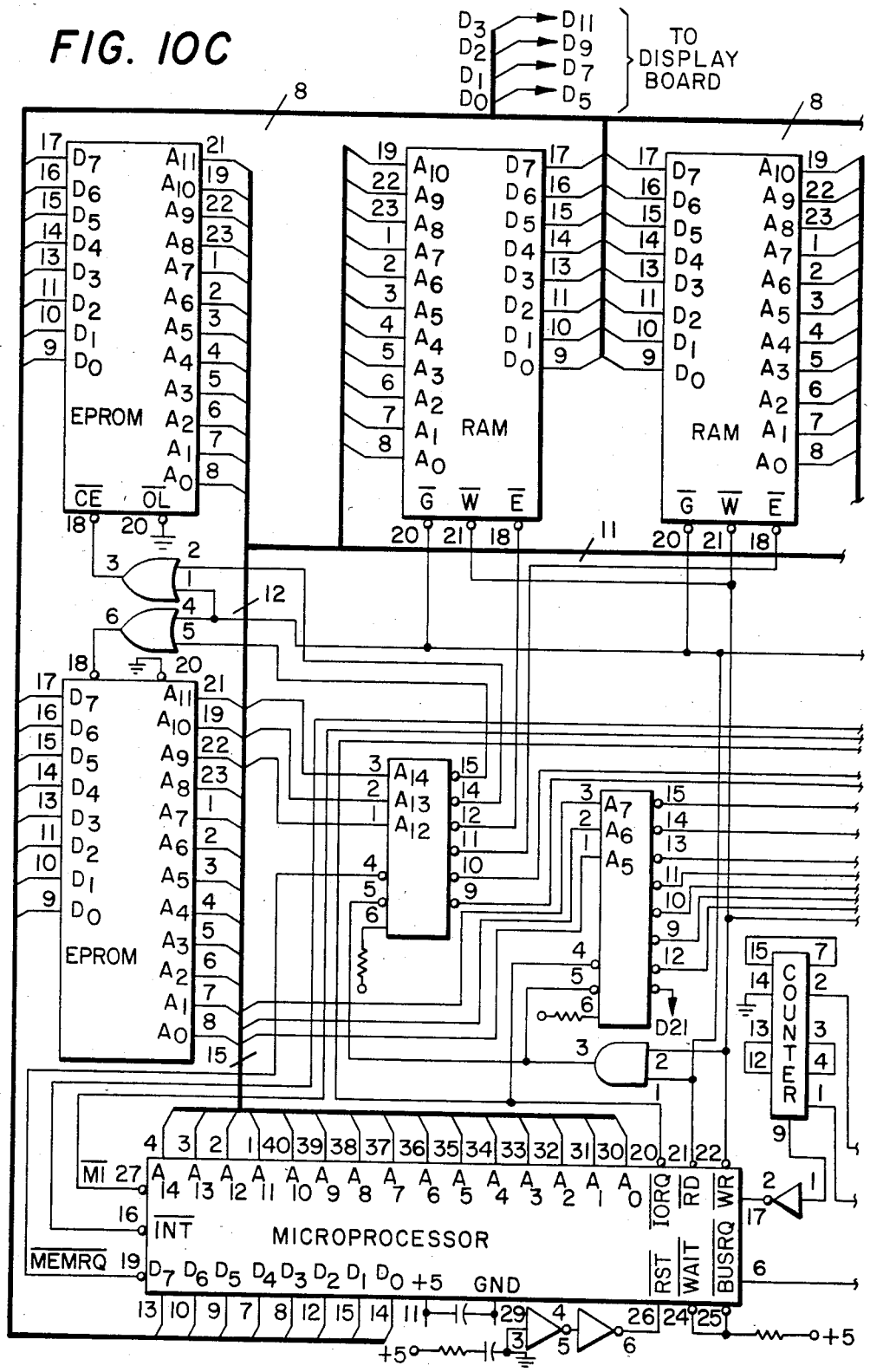

As best illustrated in FIGS. 7–13, signals from pressure transducers 105 and 110 and potentiometer 115 are delivered through a signal conditioning apparatus to a microprocessor to provide an output to a display board in microprocessor housing 65. Signals through conductors B15 and B19 are delivered through signal conditioning circuits 120 to an analog to digital converter designated ADC 0809 in FIG. 10. The signal from potentiometer 115 is delivered through conductor 113 to the analog is digital converter. In FIG. 10 of the drawing, one signal conditioning circuit 120 is diagrammatically illustrated. However, it will be readily apparent that a signal conditioning circuit 120 will be provided for each pressure source which is to be monitored. In FIG. 10 of the drawing, three signal conditioning circuits 122, 122' and 122'' are illustrated for accommodating three potentiometers 115 for processing data relating to the angle of more than one arm 52.

Figure 8:
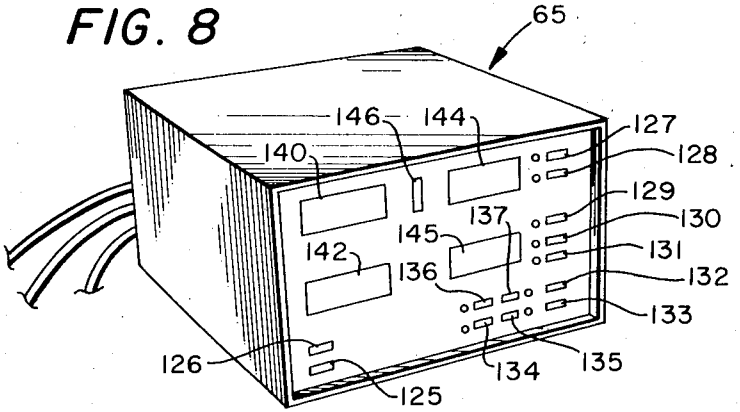
FIG. 8 is a perspective view of the housing for the microprocessor and associated switches to display desired information.
Figure 11A:
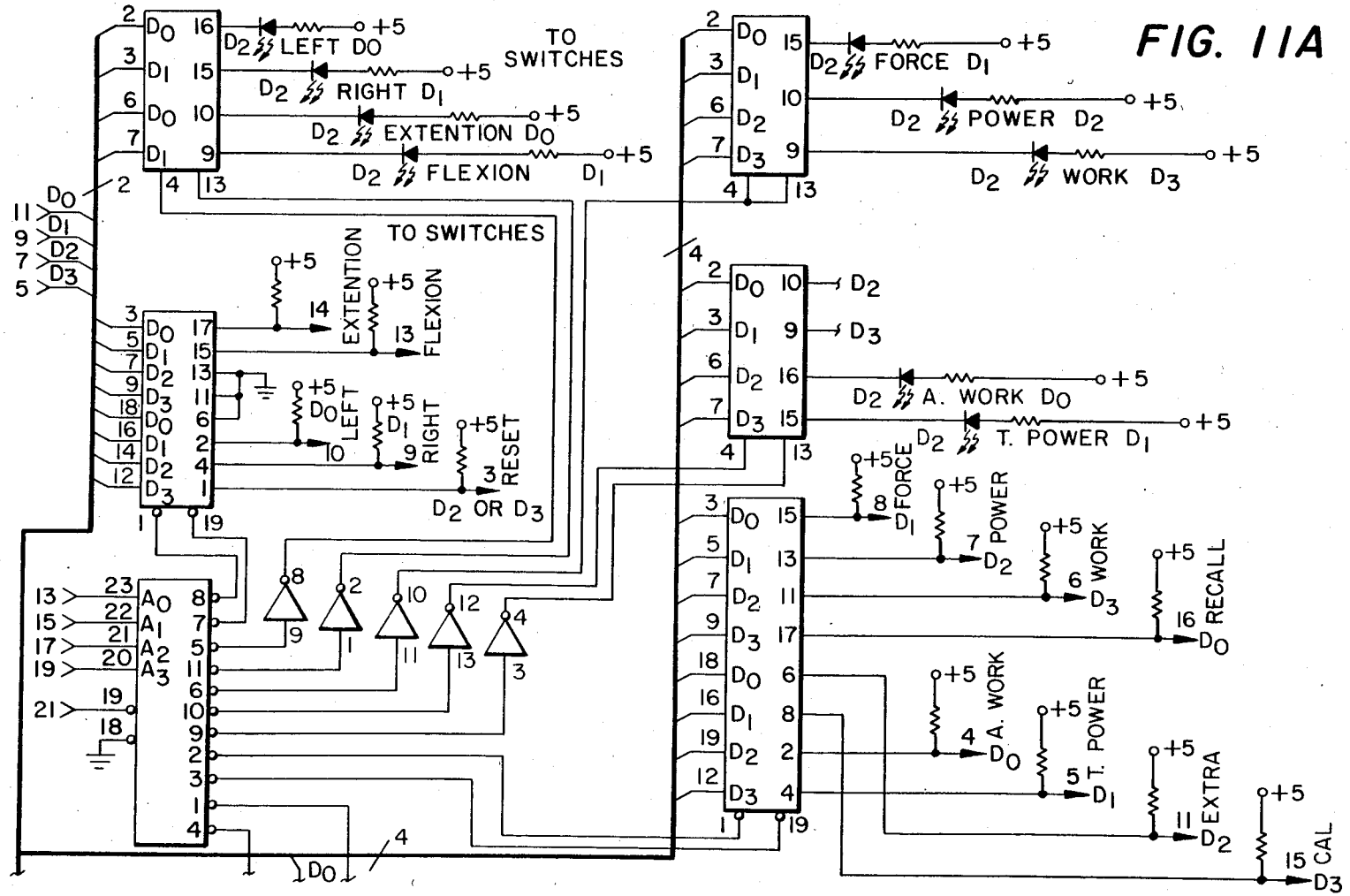
FIGS. 11A and 11B are wiring diagrams of the display board.
Figures 11B, 12, 13:
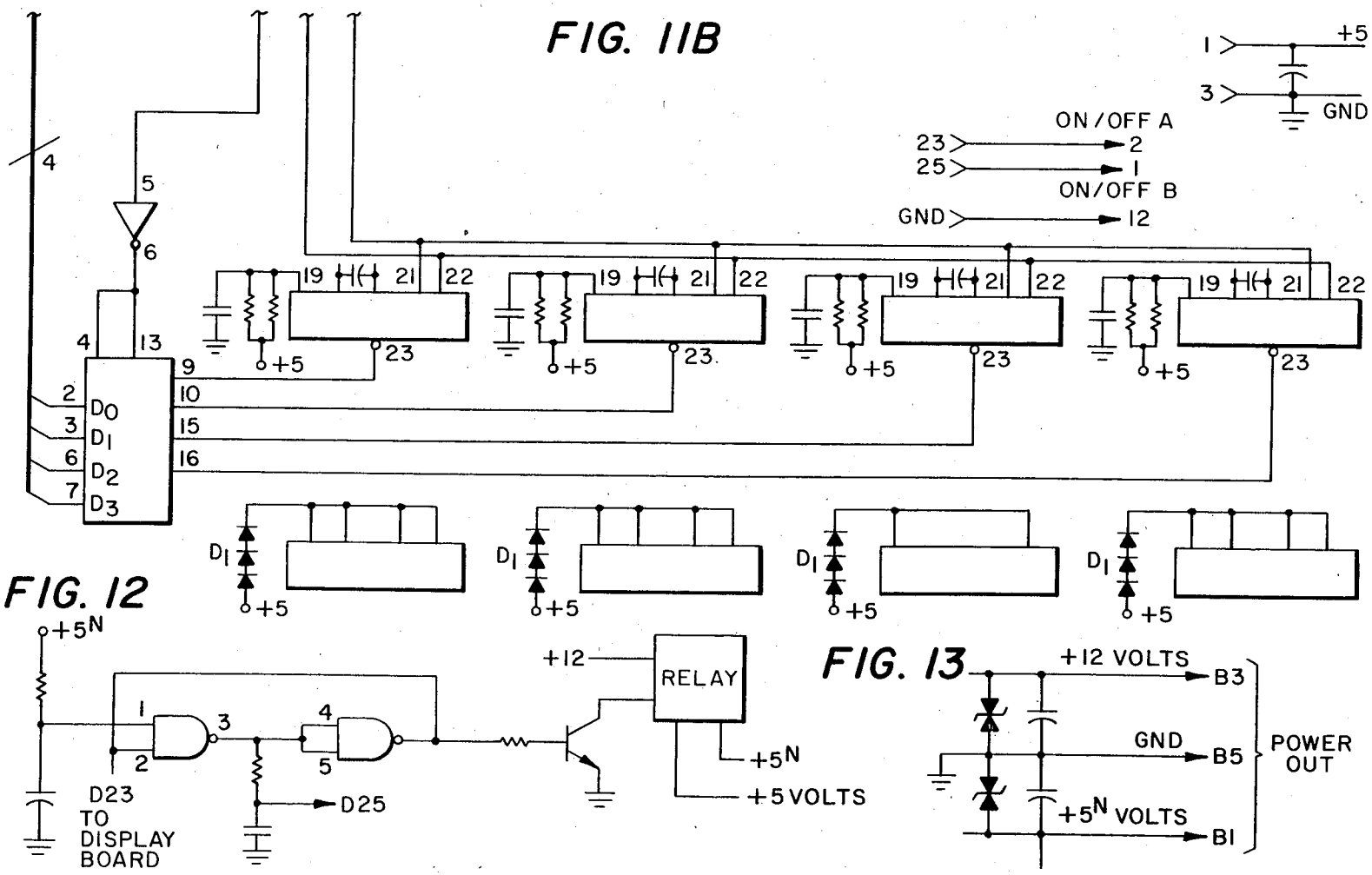
FIGS. 12 and 13 are more detailed wiring diagrams of the microprocessor housing Numeral references are employed to designate like parts throughout the various figures of the drawing.

Conductors designated "B" in FIG. 10 of the drawing, are connected to a back plate having a multipin connector and conductors labeled "D" communicate with a display board diagrammatically illustrated in FIG. 11A. Display board is connected through switches to light emitting diodes visible from the front of housing 65. As best illustrated in FIG. 8, the front of housing 65 is provided with an on-off switch 125 and a reset switch 126 on the left side of the housing and a column of switches 127–133 adjacent the right side of the housing along with switches 134–137 on a central portion of the face. Light emitting diodes 140, 142, 144 and 145 display data which is visible to the user and a diode is positioned adjacent each of the switches 125–137 to indicate which switch is in the active position.

Switch 125 is the power switch for turning the system "on and off" and switch 126 is a "reset" switch for resetting a timing cycle. "Elapsed time" is indicated in display 142 and the number of "repetitions", which would be movement of arm 52 from a lower position to an elevated position and back to the lowered position, are indicated by indicator 140.

Switches 127 and 129 would be labeled "work" on the face of the panel. If switch 129 were activated, a number in window 145 would indicate work done during the "previous repetition". When switch 127 is activated, the "accumulated" work since the system was reset will be indicated.

Switches 128 would be labeled "power" and when activated would display power exerted during the "previous repetition" in window 145 and the "accumulated" power in window 144. Switch 132 would be labeled "peak torque" and when switch 131 is activated, a number appearing in window 145 would indicate the maximum torque exerted on arm 52 during the previous repetition.

Switch 132 would be labeled "recall" and when pressed will cause data to be recalled to the system, the number of the particular repetition appearing in window 140 and the peak torque, power or work as selected by switches 129-130 to appear in window 145. Switch 133 is a calibration switch which is employed for initial calibration of the system to establish the angular extremes of a cycle or a single repetition.

Switches 136 and 137 would be labeled "right" and "left", respectively. When a user is seated on seat 34, the strength of his left leg would be indicated. When a user is seated in seat 32, the strength of his right leg would be indicated. A single arm 52 is employed to assure that any error appearing as a result of bearing friction, variation in diameter of cylinders or valve orifices will be eliminated from the system since both the right and left leg will be exercising the same actuating member. Light 145 is illuminated during the timed cycle and is turned on to indicate the beginning of the exercise.

The wiring diagrams of the circuit boards and display boards are illustrated in FIGS. 10–13 of the drawings, and are believed to be self explanatory. As illustrated in FIG. 9 of the drawing, the circuitry is connected through cable B7-19 to pressure transducers 105 and 110 and to angular potentiometer 115 as hereinbefore described. The system is connected through a cable labeled "J3" for inputting the data to a personal computer. Pin connector J3 from parallel interface 8420 is illustrated in FIG. 10B of the drawing.

When the data has been delivered to the personal computer, the data can be permanently stored on tapes or discs for observation at a later date. It will be readily apparent that the data may be illustrated graphically to assist the user or a therapist in determining the strength of each body member at each angle throughout a repetition of an exercise and to compare the data at each angle during each repetition at various times during a training or rehabilitation program. It will be appreciated that cylinder 70 and valve 95 associated therewith permit adjustment of resistance to extension or retraction of rod 85 independently and may be adjusted to provide substantially no resistance to movement in either direction while exerting substantial resistance in the other direction. Thus, the cylinder 70 can be made as a single acting cylinder upon movement of the piston in either direction or as a double acting cylinder by merely rotating knobs 100 and 101 on valve housing 95.

Having described the invention, what is claimed is:

1. A double acting hydraulic cylinder comprising first and second tubular members, the second tubular member extending through the first tubular member forming an annulus between walls of the first and second tubular members; a single piston in said second tubular member; spaced closure means in said annulus forming a reservoir; check valve means having a passage communicating with the reservoir and the inside of the second tubular member, said check valve means being adapted to permit flow of fluid from the reservoir to the inside of the second tubular member and to block flow of fluid from each end of the second tubular member to the reservoir; first valve means arranged to meter flow of fluid from a first end of the cylinder to said reservoir upon movement of said piston in the second tubular member in a first direction; second valve means arranged to meter flow of fluid from a second end of the cylinder to sadi reservoir upon movement of said piston in the second tubular member in a second direction; a valve element in each of said valve means to independently and selectively meter fluid flow from each end of the second tubular member to the reservoir upon movement of said piston in opposite directions.

2. A double acting hydraulic cylinder according to claim 1, with the addition of an accumulator in fluid communication with the reservoir, said accumulator being precharged to a specified pressure for maintaining fluid pressure in said reservoir.

3. A double acting hydraulic cylinder according to claim 1 with the addition of a pair of pressure transducers in fluid communication with the interior of said second tubular member adjacent opposite sides of said piston and adapted to generate electric signals related to fluid pressure adjacent opposite ends of said cylinder; and indicator means associated with said pressure transducers to indicate pressure adjacent opposite ends of said cylinder.

4. A double acting hydraulic cylinder according to claim 3 with the addition of: a microprocessor associated with said pressure transducers, said mircoprocessor being adapted to receive and store data from said pressure transducers.

5. A double acting cylinder according to claim 4 with the addition of position indicating means adapted to deliver an electrical signal to the microprocessor related to the position of the piston in the hydraulic cylinder; and display means associated with the microprocessor to indicate force exerted on said piston at different positions of said piston in the cylinder.

6. A double acting cylinder according to claim 1, said first and second valve means being mounted in a common valve body, said common valve body being provided with a return passage and first and second inlet passages; said valve elements in said first and second valve means being positioned in said valve body, said valve element in said first valve means being positioned between said first inlet passage and said return passage and said valve element in said second valve means being positioned between said second inlet passage and said return passage; a first flow line communicating with said first inlet passage in said valve body and a first end of said second tubular member; a second flow line communicating with said second inlet passage in said valve body and a second end of said second tubular member; and a return line communicating with said return passage in said valve body and said reservoir.

7. A double acting cylinder according to claim 6, with the addition of first and second pressure transducers, said first pressure transducer generating a signal related to pressure of fluid in said first inlet passage in said valve body and said second transducer generating a signal related to pressure in said second inlet in said common valve body.

8. In an exercising device, a frame; an actuated member; means movably securing said actuated member to said frame; a double acting hydraulic cylinder having a single piston movably disposed therein; means pivotally securing said cylinder between said frame and said actuated member; first valve means arranged to meter flow of fluid from a first end of the cylinder to a second end of the cylinder upon movement of said piston in the cylinder in a first direction; second valve means arranged to meter flow of fluid from a second end of the cylinder to a first end of the cylinder upon movement of said piston in the cylinder in a second direction; a valve element in each of said valve means, each of said valve elements having a plurality of orifices of varying sizes positionable in communication with flow passages communicating with the inside of the cylinder to independently and selectively adjust resistance of fluid flow from each end of the cylinder; force sensing means associated with said actuated member and adapted to generate a signal related to the magnitude of force exerted on said actuated means; angle sensing means associated with said actuated member adapted to generate a signal related to the position of the actuated member; means converting said signals to digital signals at preselected intervals of time and delivering digital signals to a microprocessor; and display means associated with said microprocessor, said display being adapted to indicate elapsed time, repetitions of the actuated member, and force exerted during a repetition.

9. An exercising device according to claim 8, said actuated member comprising: an actuating arm; and leg engaging means on said actuating arm.

10. An exercising device according to claim 9, said frame including: a seat portion and a back portion; and a leg retraining means on said frame to prevent movement of one leg of a user when the other leg of the user is in engagement with said leg engaging means on said actuating arm.

11. An exercising device according to claim 10, said leg restraining means comprising: pad means spaced to engage opposite sides of a leg of a user; and means securing said pad relative to said frame.

12. An exercising device according to claim 11, said leg engaging means comprising: a pad; means movably securing said pad relative to said actuating arm to prevent movement of the pad relative to the leg of a user when the actuating arm is moved relative to the frame.

13. An exercising device according to claim 12 with the addition of means carried by said actuating arm to engage a leg of a user adjacent said pad, said pad being positioned to move said actuating arm in a first direction upon movement of the leg of a user in said first direction and said means carried by said actuating arm being positioned to move said actuating arm in a second direction upon movement of the leg of a user in said second direction.

14. An exercising device according to claim 12, said actuating arm comprising: a hollow tubular member; a bar slidably disposed in said tubular member; lock means releasably securing said bar relative to said tubular member to maintain said leg engaging means an established distance from said means securing the actuating arm to the frame.

15. An exercising device according to claim 12, said seat portion being inclined at an angle of approximately 15° from a horizontal plane such that a front edge of the seat portion is elevated above a rear edge of the seat portion, said back portion being inclined relative to said seat portion at an angle of approximately 110°.

16. An exercising device according to claim 10 with the addition of seat belts provided for restraining the body of a user relative to said seat portion.

17. An exercising device according to claim 10 with the addition of extendible means securing said back portion to said frame to permit adjustment of said back portion relative to said seat portion.

18. An exercising device according to claim 17, said extendible means securing said back portion to said frame comprising: a hollow tubular member; a bar slidably disposed in said tubular member; lock means releasably securing said bar relative to said tubular member to maintain said back portion in an established relationship relative to said seat portion.

19. An exercising device according to claim 18 with the addition of thigh straps to engage the thigh of a user when seated on said seat portion.

20. An exercising device according to claim 19 said leg engaging means on said actuating arm comprising: a pad; means pivotally securing said pad to said actuating arm such that said pad engages the front of the shin of the leg of a user when the user is seated on said seat portion of said frame; an ankle strap secured to said pad; a thigh strap secured to said frame to engage the thigh of the leg of a user.

21. An exercising device according to claim 19, said first and second valve means being mounted in a common valve body, said common valve body being provided with a return passage and first and second inlet passage; said first and second valve elements being positioned in said valve body, said first valve element being positioned between said first inlet passage and said return passage and said second valve element being positioned between said second inlet passage and said return passage; a first flow line communicating with said first inlet passage in said valve body and a first end of said double acting hydraulic cylinder; a second flow line communicating with said second inlet passage in said valve body and said second end of said double acting cylinder; a return line communicating with said return passage in said valve body and a central portion of said double acting hydraulic cylinder.

22. An exercising device according to claim 21, said force sensing means associated with said actuated member comprising: first and second pressure transducers, said first pressure transducer generating a signal related to pressure to fluid in said first inlet passage in said valve body and said second transducer generating a signal related to pressure in said second inlet in said common valve body.

23. An exercising device according to claim 22, said means movably securing said actuated member to said frame comprising a bearing sleeve secured to said actuated member; and said angle sensing means comprising a potentiometer having a wheel mounted thereon positioned in rolling engagement with said bearing sleeve such that movement of said actuated member imparts rotational movement to said sleeve and said wheel for adjusting the resistance of said potentiometer.

24. An exercising device according to claim 23, said display means comprising magnetic storage media and means displaying information for use in determining the strength of a body member at each angle throughout a repetition of an exercise and comparing the strength of the member at each angle during each repetition at various times during a training or rehabilitation program.

* * * * *

UNITED STATES PATENT AND TRADEMARK OFFICE

CERTIFICATE OF CORRECTION

PATENT NO. : 4,566,692

DATED : January 28, 1986

INVENTOR(S) : Jerry D. Brentham

It is certified that error appears in the above-identified patent and that said Letters Patent is hereby corrected as shown below:

Column 6, line 47, change "sadi" to -- said --

Signed and Sealed this

*Ninth* Day of *September 1986*

[SEAL]

*Attest:*

DONALD J. QUIGG

*Attesting Officer*

*Commissioner of Patents and Trademarks*